United States Patent [19]

Sullivan et al.

[11] Patent Number: 4,497,276

[45] Date of Patent: Feb. 5, 1985

[54] APPARATUS AND METHOD FOR APPLYING PLASTICIZERS TO FIBROUS FILTER MATERIAL

[75] Inventors: James W. Sullivan, Glendale; Robert T. Lewis, Louisville, both of Ky.

[73] Assignee: Brown & Williamson Tobacco Corporation, Louisville, Ky.

[21] Appl. No.: 321,979

[22] Filed: Nov. 16, 1981

[51] Int. Cl.[3] ..... B05B 9/00

[52] U.S. Cl. ..... 118/694; 118/325; 118/326; 427/424

[58] Field of Search ..... 118/694, 325, 326, DIG. 16; 427/424, 429

[56] References Cited

U.S. PATENT DOCUMENTS

| | | | |
|---|---|---|---|
| T874,005 | 5/1970 | Fritz et al. | 118/325 |
| 2,403,018 | 7/1946 | Oglesby | 118/325 X |
| 3,387,992 | 6/1968 | Arthur et al. | 118/325 |
| 3,741,846 | 6/1973 | Greve | 118/325 |
| 4,132,189 | 1/1979 | Greve et al. | 118/325 X |
| 4,313,974 | 2/1982 | Greve et al. | 118/325 |
| 4,367,249 | 1/1983 | Bloom et al. | 427/424 |
| 4,381,730 | 5/1983 | Arthur | 118/674 |

FOREIGN PATENT DOCUMENTS

| | | |
|---|---|---|
| 1290346 | 9/1972 | United Kingdom . |
| 1328151 | 8/1973 | United Kingdom . |

*Primary Examiner*—Shrive P. Beck

*Attorney, Agent, or Firm*—Charles G. Lamb

[57] ABSTRACT

A filter rod making machine is provided with an apparatus for applying plasticizer to a band of fibrous filter material wherein the application rate of the plasticizer is independent of the filter tow weight or width of the band passing through the apparatus. The plasticizer is added to the underside of the moving band by means of a rotatively mounted brush in rotating communication with a plasticizer supply source wherein the amount of plasticizer added to the band is dependent upon the amount of plasticizer metered by a constant volume pump. The rotatively mounted brush delivers liquid plasticizer in the form of a spray to the underside of the moving band. Variable changes in the level of the liquid plasticizer in the reservoir varies the amount of plasticizer being presented to the band, maintaining constant absorption rate regardless of tow band width.

2 Claims, 3 Drawing Figures

APPARATUS AND METHOD FOR APPLYING PLASTICIZERS TO FIBROUS FILTER MATERIAL

BACKGROUND OF THE INVENTION (1) Field of the Invention

The present invention relates to an improvement in an apparatus for applying a liquid plasticizer to a continuously moving tow band of filamentary filter material. More particularly, the present invention relates to an apparatus for applying plasticizer to fibrous filter material wherein the application rate of the plasticizer is independent of the filter tow band weight or tow band width.

(2) Description of the Prior Art

Filter rod making machines for making filter rods specifically used for cigarette filters are generally provided with apparatus for applying plasticizers to fibrous filter tow material. Plasticizers are softening agents which promote adherence between the filaments to form an integral filament network. Conventionally the means for adding plasticizer to moving filament tow in a filter rod making machine is by spraying plasticizer in the form of fine droplets against one side, usually the underside, of a traveling layer of fibrous filter material. A number of patents which deal with the addition of plasticizer to the filter tow include U.S. Pat. No. 3,387,992; U.S. Pat. No. 3,733,246; U.S. Pat. No. 3,741,846; U.S. Pat. No. 3,769,883; U.S. Pat. No. 3,865,016; U.S. Pat. No. 3,974,007; U.S. Pat. No. 4,019,942; U.S. Pat. No. 4,046,064; U.K. Patent Application No. 2042375A; and, U.S. Pat. No. 4,132,189. In U.S. Pat. No. 4,132,189, an apparatus for applying plasticizer to a band or sheet of cigarette filter material is disclosed wherein, in one embodiment, a rotary brush is disposed beneath a moving filter band. The rotary brush is disposed in a plasticizer receptacle to pick up plasticizer and spray it or fling it upwardly to the underside of the filter sheet. A main plasticizer supply tank is connected to an intermediate plasticizer tank by a conduit, and a centrifugal pump moves the plasticizer through the conduit from the main supply tank to an intermediate supply tank. The intermediate tank is connected to the plasticizer receptacle by another conduit and a variable speed pump is provided to move the plasticizer from the intermediate tank to the plasticizer receptacle. The intermediate tank is also provided with an overflow conduit communicating the main supply tank so that the level of plasticizer in the intermediate tank remains constant. The rate of flow of plasticizer from the intermediate tank to the plasticizer receptacle having the rotary brush is controlled by the variable speed pump as a function of the speed at which the filter sheet moves past the rotary brush. However, in operation, if the width or thickness of the filter sheet changes as it passes through the apparatus, different amounts of plasticizer will be added to the filter sheet and nonuniformity of plasticizer in the filter rod will result.

SUMMARY OF THE INVENTION

In the present invention, it is recognized that it is desirable to provide an improved apparatus for applying liquid plasticizer to the underside of a moving sheet of fibrous filter material. It is further recognized that it is desirable to provide an apparatus for supplying plasticizer to a sheet of fibrous material wherein the application rate of the liquid plasticizer to the sheet of fibrous filter material is independent of the filter material weight variation. Also, it is recognized that it is desirable to provide a liquid plasticizer application device having means to self-regulate the plasticizer application rate independent of a change in the width of the filter material to which the plasticizer is being added.

Various other features of the present invention will become obvious to those skilled in the art upon reading the disclosure set forth hereinafter.

More particularly, in one advantageous embodiment, the present invention provides an apparatus for applying a controlled amount of a liquid to a moving band of filamentary material comprising a housing through which the band passes and defining a reservoir below and open to the path of the band; a brush-type liquid applicator rotatably mounted below the path of the band for spraying liquid upwardly and onto the band for absorption by the band; a manifold positioned adjacent the applicator brush for supplying the liquid to the brush; a liquid supply source; means establishing liquid flow communication from the liquid supply source to the reservoir; constant volume rate of flow pump means in the liquid communication means for moving a constant volume of liquid flow from the supply source to the reservoir equal to the amount of liquid to be ultimately absorbed by the band; means establishing liquid flow communication from the reservoir to the manifold; variable volume rate of flow pump in the liquid flow communication means from the reservoir to the manifold for moving a varying volume of flow of liquid from the reservoir to the manifold; control means for controlling the volume rate of flow moved from the reservoir to the manifold by the variable volume rate of flow pump as a function of the amount of liquid not absorbed by the band and draining back to the reservoir such that the amount of liquid supplied to the manifold is greater than the amount of liquid which is absorbed by the band.

In another advantageous embodiment, the present invention provides an apparatus for applying a controlled amount of a liquid to a moving band of filamentary material comprising a housing through which the band passes and defining a reservoir below and open to the path of the band; a brush-type liquid applicator rotatably mounted below the path of the band for spraying liquid upwardly and onto the band for absorption by the band; a manifold positioned adjacent the applicator brush for supplying liquid to the brush; a liquid supply source; first flow communication means for establishing liquid flow communication from the liquid supply source to the manifold; constant volume rate of flow pump means in the first flow communication means for moving a constant volume of flow of liquid to the manifold equal to the amount of liquid to be ultimately absorbed by the band; second flow communication means for establishing liquid flow communication from the reservoir to said first flow communication means downstream of the constant volume rate of flow pump means; variable rate of flow pump means in the second flow communication means for delivering liquid not absorbed by the band back to the manifold in addition to that liquid being supplied to the manifold from the supply source.

In a further advantageous embodiment, the present invention provides an apparatus for applying a controlled amount of a liquid to a moving band of filamentary material comprising a housing through which the band passes and defining a reservoir below and open to the path of the band; a brush-type liquid applicator rotatably mounted below the path of the band for spraying liquid upwardly and onto the band for absorption by the band; a dip roller rotatably mounted at the reservoir near the applicator brush and in contact with liquid collected in the reservoir to transfer liquid from the reservoir to the applicator brush; a supply source of liquid; flow communication means for establishing liquid flow communication from the supply source to the reservoir; a constant volume rate of flow pump in said liquid flow communication means for moving a constant volume of flow of liquid from said supply source to the reservoir equal to the amount to be ultimately absorbed by the band such that, as the liquid not initially absorbed by the band drains back into the reservoir, the liquid level in the reservoir rises so that the dip roller, not having to carry the liquid as far from the raised liquid level in the reservoir to the applicator brush as when the liquid level was lower, increases the rate at which liquid is carried to the applicator brush for absorption by the band.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWINGS

A better understanding of the present invention will be had upon reference to the accompanying specification and the following drawings in which like numerals refer to like parts throughout the several views and wherein.

DETAILED DESCRIPTION OF THE ADVANTAGEOUS EMBODIMENTS

Figure 1:
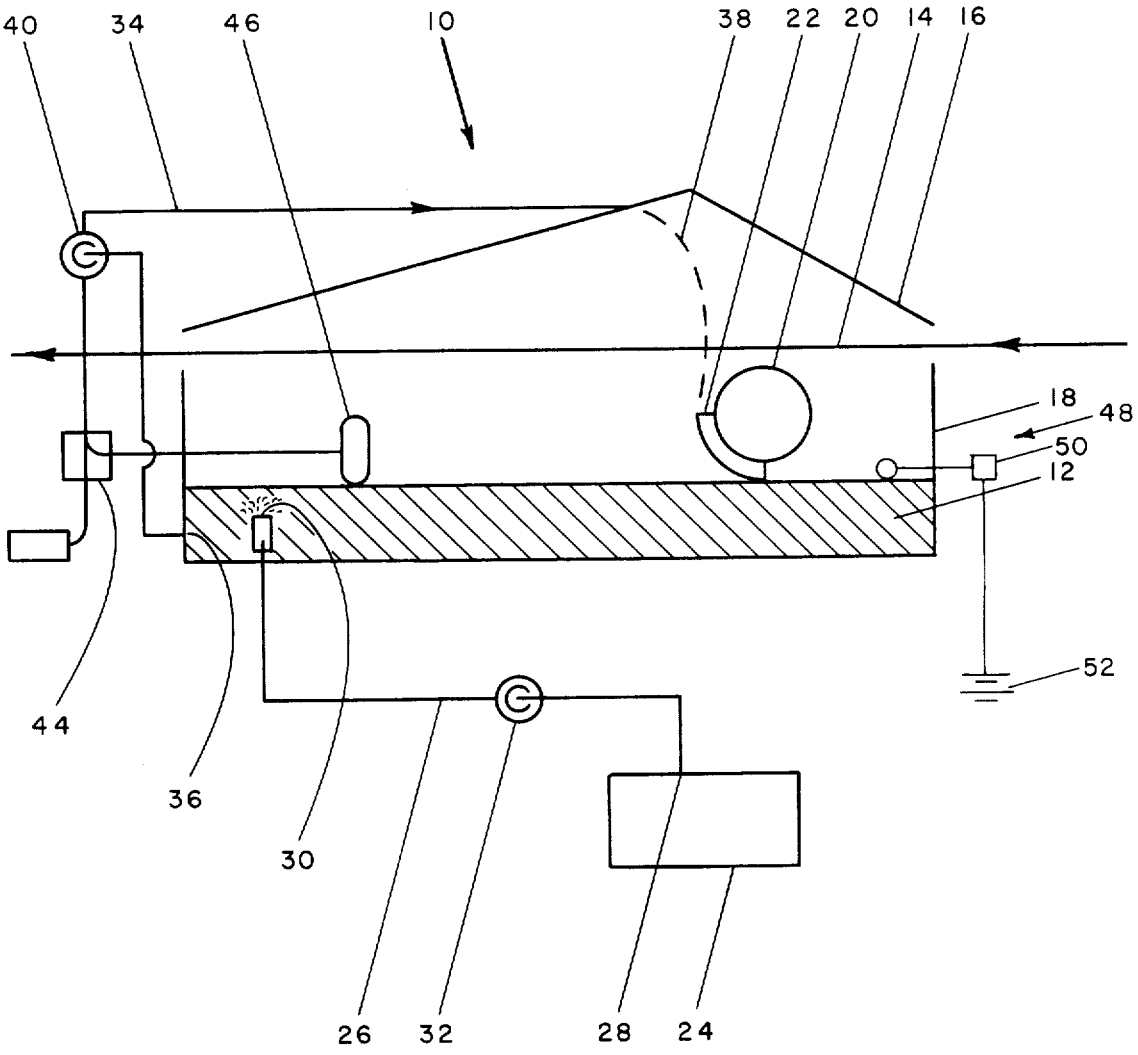
FIG. 1 is a diagrammatic representation of an advantageous embodiment of the present invention.

With reference to FIG. 1, there is shown, in diagrammatic form, an advantageous embodiment of an apparatus, generally denoted as the numeral 10, for applying a controlled amount of a liquid 12 to a moving tow or band 14 of filamentary material of the type used, for example, to manufacture cigarette filters.

As illustrated, the apparatus 10 comprises a housing 16 through which the band 14 passes. The housing 16 defines a liquid reservoir 18 below and open to the path of the band 14 through the housing 16. The apparatus 10 includes a brush-type liquid applicator 20 rotatably mounted within the housing 16 below the path of the band 14. A manifold 22 is positioned adjacent the applicator brush 20 to supply liquid to the applicator brush 20. The applicator brush is driven at a constant angular velocity, and as it rotates it sprays liquid in a mist upwardly and onto the band 14 passing above for absorption by the band 14. The apparatus 10 further comprises a liquid supply source 24 in liquid flow communication with the reservoir 18 by, for example, a liquid supply conduit 26 having an inlet end 28 open to the interior of the liquid supply source 24 and an outlet end 30 open to the interior of the liquid reservoir 18 of the housing 16. The liquid 12 is moved through the liquid supply conduit 26 by means of a constant volume rate of flow pump 32, such as a positive displacement pump of virtually any convenient type, for example a gear pump. The constant volume rate of flow pump 32 is appropriately controlled to deliver liquid 12 to the reservoir equal to the amount of liquid to be ultimately absorbed by the band 14. In a gear pump, the amount of liquid pumped can be selectively changed by altering the pump RPM. Liquid flow communication is established from the reservoir 18 to the manifold 22 by means of, for example, a liquid conduit 34 having an inlet end 36 open to the reservoir 18 and an outlet end 38 connected to the manifold 22. Variable volume rate of a flow pump 40 disposed in the conduit 34 moves the liquid 12 through the conduit from the reservoir 18 to the manifold 22 for application to the brush applicator 20. The variable volume rate of flow pump 40 can be virtually any convenient type of pump, but is preferably a positive displacement pump operable to rotate at various speeds. The volume of flow of liquid pumped by the variable rate of flow pump 40 is controlled as a function of the level of the liquid 12 in the reservoir 18 which is a function of the amount of liquid not initially absorbed by the band 14 and which drains from the band back into the reservoir 18. To this end, the speed of the variable rate of flow pump means is regulated by, for example, an electrical or pneumatic speed regulator 44 operable in response to the level of the liquid 12 in the reservoir. This can be accomplished by means of a float 46 operatively connected to the regulator 44 which rises and falls with the level of the liquid 12 in the reservoir 18. Thus, as liquid to be absorbed by the band 14 is applied by the brush applicator 20 to the band, not all of it will be initially absorbed by the band. The portion of the liquid not absorbed will drain from the band 14 back into the reservoir thereby raising the level of the liquid 12 in the reservoir. As the level of the liquid in the reservoir rises, the float 46 will rise with it and cause the variable volume rate of flow pump 40 to increase the volume of flow of liquid it pumps from the reservoir 18 to the manifold 22 through the conduit 34 to a volume greater than that amount of liquid which is desired to be absorbed by the band 14. Thus, the desired quantity of liquid to be absorbed by the band is brought into equilibrium with the liquid being supplied by the pump to the reservoir and the liquid level in the reservoir will stabilize.

As a safety measure, the apparatus 10 includes means, generally denoted as the numeral 48, for detecting the liquid level in the reservoir 18. As illustrated in FIG. 1, the level detecting means 48 comprises a float activated switch device 50 operatively connected to a signal device or to the power supply, denoted as the numeral 52, to the apparatus 10. If the liquid level in the reservoir exceeds a predetermined maximum or falls below a predetermined minimum, the level detecting means is activated setting off the signal device or turning off the apparatus 10. Thus, the production of a defective band 14 is avoided.

Figure 2:
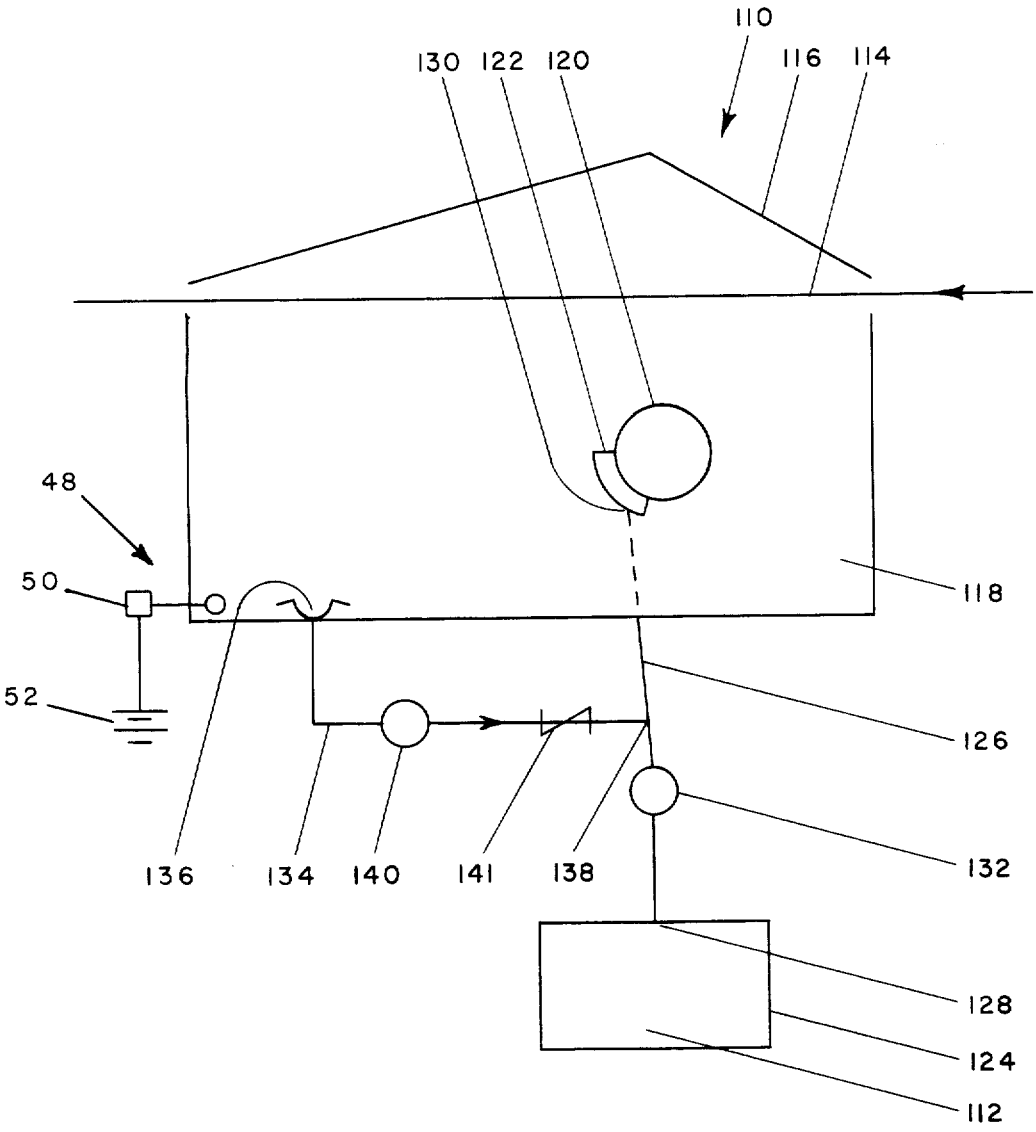
FIG. 2 is a diagrammatic representation of another advantageous embodiment of the present invention; and, FIG. 3 is a diagrammatic representation of a further advantageous embodiment of the present invention.

FIG. 2 diagrammatically illustrates another advantageous embodiment of an apparatus, generally denoted as the numeral 110, for applying a controlled amount of a liquid 112 to a moving band 114 of a filamentary material.

As shown, the apparatus 110 comprises a housing 116 through which the tow 114 passes. A reservoir 118 is defined in the housing 116 below and open to the path of the band 114 through the housing. A brush-type liquid applicator 120 is rotatably mounted within the housing 116 below the path of the band 114. A manifold 122 is located adjacent the applicator brush 120 to supply liquid to the applicator brush 120. The applicator brush 120 is driven at a constant angular velocity, and as it rotates it sprays a mist of liquid upwardly and onto the band 114 passing above for absorption by the tow. The apparatus 110 further comprises a liquid supply source 124 in liquid flow communication with the manifold 122 by, for example, first flow communication means illustrated as a liquid supply conduit 126 having an outlet end 130 in communication with the manifold 122. The liquid 122 is moved through the liquid supply conduit 126 by means of a constant volume rate of flow pump 132 such as a positive displacement pump of virtually any convenient type. The constant volume rate of flow pump 132 is appropriately controlled to deliver liquid to the manifold 122 equal to the amount of liquid to be ultimately absorbed by the band 114. Second flow communication means, illustrated as a liquid conduit 134 having its inlet end 136 open to the reservoir 118 and its outlet end 138 connected to the liquid supply conduit 126 downstream of the constant volume rate of flow pump 132 establishes liquid flow communication from the reservoir 118 to the first flow communication means. Variable rate of a flow pump 140 located in the conduit 134 moves the liquid not absorbed by the band 114 and which drains back in the reservoir 118 back to the liquid supply conduit 126 through conduit 134 and pumped into conduit 126 by pump 140 downstream from pump 132. Therefore, the quantity of liquid absorbed by the band 114 is brought into equilibrium with the amount of liquid being supplied to the reservoir by the positive displacement pump 132.

It should be noted that the liquid level detecting means 48 discussed in regard to the apparatus 10 of FIG. 1 can be included in the apparatus 110 of FIG. 2. A check valve 141 is located in the conduit 134 downstream of the variable rate of flow pump 140 to prevent liquid flowing from the supply conduit 126 into the conduit 134.

Figure 3:
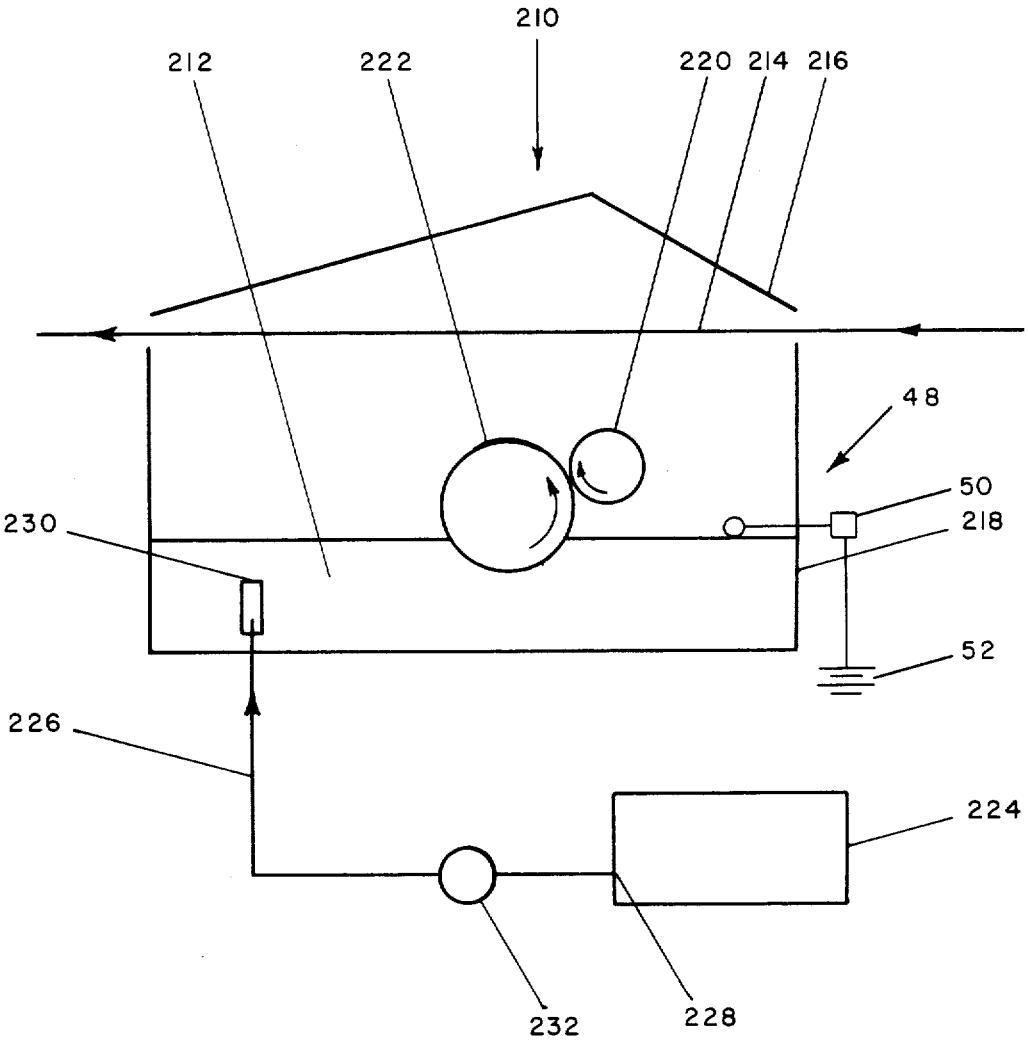

FIG. 3 diagrammatically illustrates a further advantageous embodiment of an apparatus 210 for the present invention for applying a controlled amount of a liquid 212 to a moving band 214 of a filamentary material.

As illustrated, the apparatus 210 comprises a housing 216 through which the tow 214 passes. A reservoir 218 is defined in the housing below and open to the path of the band 214. A brush-type liquid applicator 220 is rotatably mounted within the housing 216 above the level of the liquid 212 in the reservoir 218 and below the path of the band 214. A dip roller 222 is rotatably mounted at the reservoir 218 near the applicator brush 220 and in contact with the liquid 212 collected in the reservoir 218. The dip roller 222 is rotatably driven at a constant angular velocity to transfer liquid from the reservoir to the applicator brush 220. The applicator brush 220 is rotatably driven in the opposite rotational direction from that of the dip roller 222, and as it rotates it sprays a mist of liquid upwardly and onto the band 214 passing above for absorption by the band. A supply source 224 of liquid 212 is in flow communication with the reservoir 218 by means of, for example, a liquid supply conduit 226 which has an inlet end 228 open to the interior of the liquid supply source 224 and an outlet end 230 open to the interior of the reservoir 218. The liquid 212 is moved through the liquid supply conduit 226 from the liquid supply source 224 to the reservoir 218 by means of a constant volume rate of flow pump 232. The pump 232 can be virtually any convenient type of positive displacement pump, for example, a gear pump. The constant volume rate of flow pump 232 is appropriately controlled to deliver liquid 212 to the reservoir 218 equal to the amount of liquid to be ultimately absorbed by the band. In a gear pump, the amount of liquid pumped can be selectively changed by altering the pump RPM. Initially, the band will not absorb all of the liquid it is desired to be applied thereto, and the liquid not absorbed drains therefrom back into the reservoir 218. As the level of liquid 212 in the reservoir rises, the dip roller 222 does not have to carry liquid as far from the raised liquid level to the applicator brush 220 as it had to initially when the liquid level was lower. Thus, the dip roller 222 carries an excess of liquid to the applicator brush 220 and the tow. The amount of liquid absorbed by the band eventually is brought into equilibrium with the amount of liquid supplied by the positive displacement pump 232.

It should be clearly understood that the liquid level detecting means 48 discussed above in relationship to the apparatus 10 of FIG. 1 can also be advantageously incorporated into the apparatus 210 of FIG. 3.

Thus, it can be seen that the apparatus of the present invention is capable of supplying an over-abundance of liquid to the tow without any waste of liquid to assure that the tow is saturated with the proper amount of liquid.

The foregoing detailed description is given primarily for clarity of understanding and no unnecessary limitations should be understood therefrom for modifications will be obvious to those skilled in the art upon reading this disclosure and may be made without departing from the spirit of the invention or the scope of the appended claims.

What is claimed is:

1. An apparatus for applying a controlled amount of a liquid to a moving band of filamentary material, comprising:

a housing through which said band passes and defining a reservoir below and open to the path of said band;

a brush-type liquid applicator rotatably mounted below the path of said band for spraying liquid upwardly and onto said band for absorption by said band;

a dip roller rotatably mounted at said reservoir near said applicator brush and in contact with liquid collected in said reservoir to transfer liquid from said reservoir to said applicator brush;

a supply source of liquid;

flow communication means for establishing liquid flow communication from said supply source to said reservoir;

a constant volume rate of flow pump in said liquid flow communication means for moving a constant volume of flow of liquid from said supply source to said reservoir equal to the amount of liquid to be ultimately absorbed by said band such that, as the liquid not initially absorbed by said band drains back into said reservoir, the liquid level in said reservoir rises so that said dip roller, not having to carry the liquid as far from the raised liquid level in said reservoir to said applicator brush as when the liquid level was lower, carries an excess of liquid to said applicator brush for absorption by said band.

2. The apparatus of claim 1, further comprising means for detecting the liquid level in the reservoir and preventing the liquid level from exceeding a predetermined maximum and falling below a predetermined minimum.

* * * * *